US006428381B1

(12) United States Patent
Stern

(10) Patent No.: US 6,428,381 B1
(45) Date of Patent: Aug. 6, 2002

(54) FLYING DEVICE WHICH ROTATES AS IT TRAVELS THROUGH THE AIR

(76) Inventor: Daniel A. Stern, 941 N. Norman Pl., Los Angeles, CA (US) 90049

( * ) Notice: Subject to any disclaimer, the term of this patent is extended or adjusted under 35 U.S.C. 154(b) by 0 days.

(21) Appl. No.: 09/734,263

(22) Filed: Dec. 11, 2000

(51) Int. Cl.[7] ..... A63H 27/127
(52) U.S. Cl. ..... 446/36; 446/80; 244/138 R
(58) Field of Search ..... 244/138 R, 12.2, 244/3.24, 3.27, 3.29, 3.28; 446/46, 34, 488, 80, 487, 36; D21/436, 437

(56) References Cited

U.S. PATENT DOCUMENTS 2,044,819 A * 6/1936 Taylor
2,380,278 A * 7/1945 Weissman
2,816,764 A * 12/1957 Gleason
2,972,481 A * 2/1961 Shapiro
4,548,371 A * 10/1985 Dempsey
4,955,841 A * 9/1990 Pastrano
5,352,144 A * 10/1994 Kuhn
5,413,514 A * 5/1995 Milligan

* cited by examiner

*Primary Examiner*—Charles T. Jordan
*Assistant Examiner*—Tien Dinh
(74) *Attorney, Agent, or Firm*—Ted Masters

(57) ABSTRACT

A flying device which rotates as it travels through the air includes a body having three radially projecting vanes. Three blades or wings are pivotally connected to the three vanes. Each blade may be selectively and adjustably attached to an adjacent vane so that the blade projects outward from the body. When the flying device is thrown, the blades cause the aerial device to spin in a twirling motion. For storage or shipping, the blades may also be folded over so that they abut the body.

2 Claims, 10 Drawing Sheets

20
C
C1
C2
B
Y
B2
B1
32
X
Z
A2
A1
A

B
40
B1
B
B1
38
28
32
32
M
32
X2
Z1
22
23

32
28
32
X2
Z1
22
23

20
C
A
B

40
B
B1
32
28
32
X2
Z1
22
28
32
32
40

X2
B1
22

A
C3
C
A2
A1
20
B
B4
32
32
N
Z2
X1
22

FLYING DEVICE WHICH ROTATES AS IT TRAVELS THROUGH THE AIR

TECHNICAL FIELD

The present invention pertains generally to flying devices, and more particularly to a toy aerial device having adjustable blades which cause the device to spin when thrown.

BACKGROUND OF INVENTION

Devices which fly through the air are well known in the art. These range from airplanes to darts, and from rockets to boomerangs. In some cases such as model airplanes, the devices contain a power source which turns a propeller to force the device through the air. In other toys, such as gliders, the propelling force is provided by the user. Examples of the later category include:

U.S. Pat. No. 2,324,022 shows an aerial device of the boomerang type which has several arms. The blades of the device are entirely offset from the center of the assembly throughout their entire axes. The blades can be either the leading or trailing type. And the device provides a sound effect when the boomerang is in flight.

U.S. Pat. No. 3,361,988 illustrates a boomerang which has three folding blades. When the boomerang is thrown, the blades assume an in flight position wherein the blades are spaced apart by about 120°.

U.S. Pat. No. 2,972,481 discloses a rotating airfoil device which has interlocking blades. The device is fashioned from cardboard or other resilient sheet material. The device includes two blades which are mechanically interlocked, and which will not separate during flight.

U.S. Pat. No. 3,814,431 comprises a toy plastic boomerang having two interconnected wings arranged for free rotation on a vertical hollow handle with ballast therein to control the speed of descent. To propel, the user grasps one wing between the fingers so that the wings extend vertically with the handle extending laterally and throws the boomerang forward and vertically at a slight upward arc of approximately 45°.

U.S. Pat. No. 4,216,962 consists of a boomerang having a pair of elongated airfoils which are coupled together at their midsections to form a cross. Mechanism is provided for releasably coupling the midportions of the airfoils for separation under a predetermined force to normally prevent relative rotation of the airfoils.

SUMMARY OF INVENTION

The present invention is directed to a toy flying device (also referred to herein as an aerial device) which rotates or spins when it is thrown. The device can be used by a single user, or alternatively, by two users who throw the device back and forth. A preferred name is for the aerial device of the present invention is "TWIRLYBIRD". The aerial device consists of a body which has three outwardly projecting vanes to which are attached,three blades or wings. When the device is thrown, the blades catch the air and cause the aerial device to spin. Changing the angle formed by the blades and body changes the flight characteristics of the aerial device. And, for storage or shipping, the aerial device may be conveniently folded so that the blades abut the body.

In accordance with a preferred embodiment of the invention, an aerial device includes a weighted body having a first end and an opposite second end, the body having at least three outwardly projecting vanes located at the first end. The aerial device further includes, at least three corresponding blades, each blade pivotally connected to a vane along an axis, so that the blades may be folded against the body. Each blade is also selectively connectable to an adjacent vane, so that during flight the blade projects outwardly from the body.

In accordance with an important aspect of the invention, hook and loop fasteners are utilized to selectively connect the blade to the adjacent vane.

In accordance with an important feature of the invention, the body has three vanes and three blades, one blade being connected to each vane.

In accordance with another important aspect of the invention, when the aerial device is in a ready for use configuration, the blades include two surfaces which intersect to form an obtuse angle.

Other features and advantages of the present invention will become apparent from the following detailed description, taken in conjunction with the accompanying drawings, which illustrate, by way of example, the principles of the invention.

DETAILED DESCRIPTION OF THE INVENTION

Figure 1:
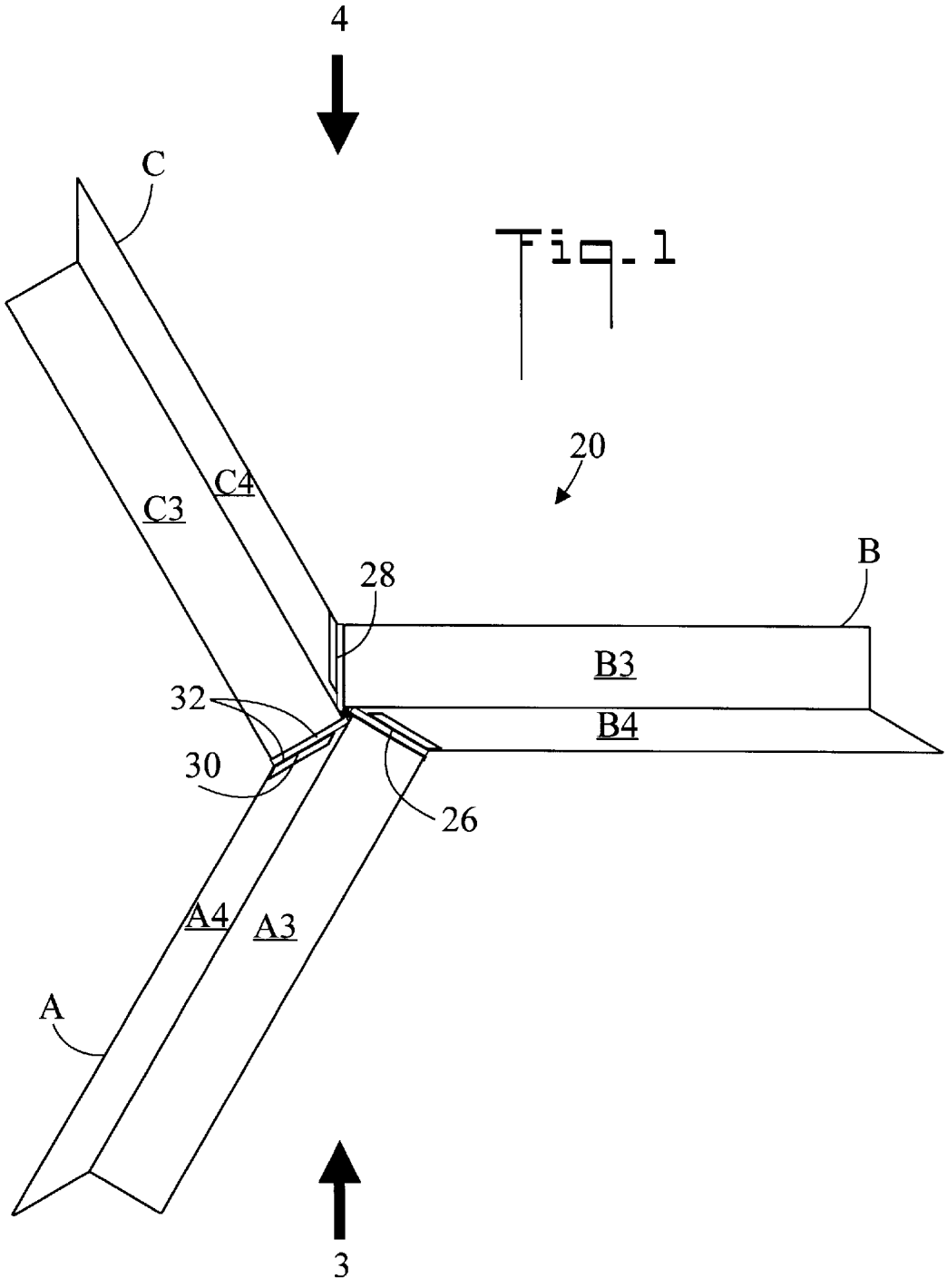
FIG. 1 is a top plan view of an aerial device in accordance with the present invention.
Figure 2:
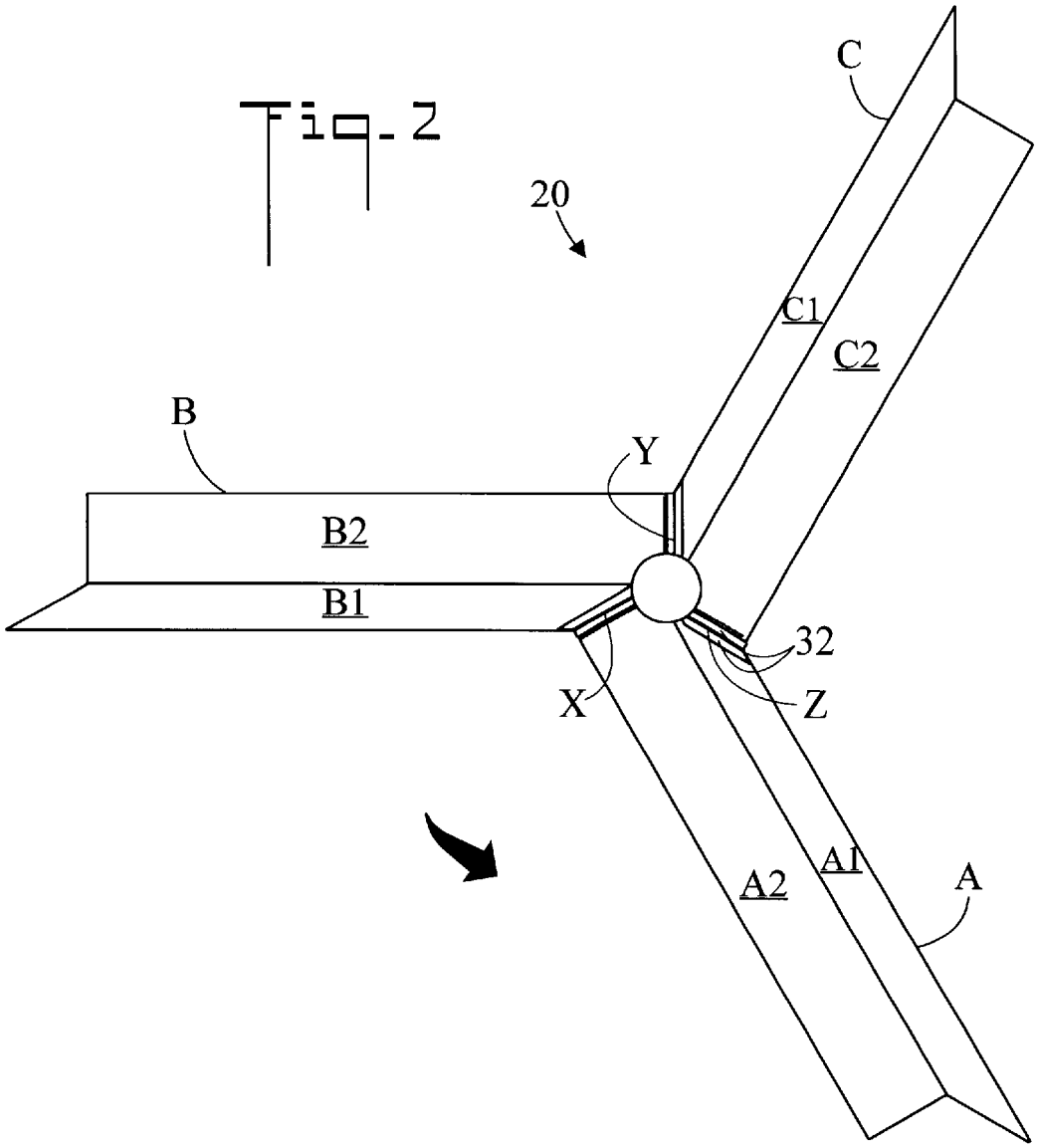
FIG. 2 is a bottom plan view of the device.
Figure 3:
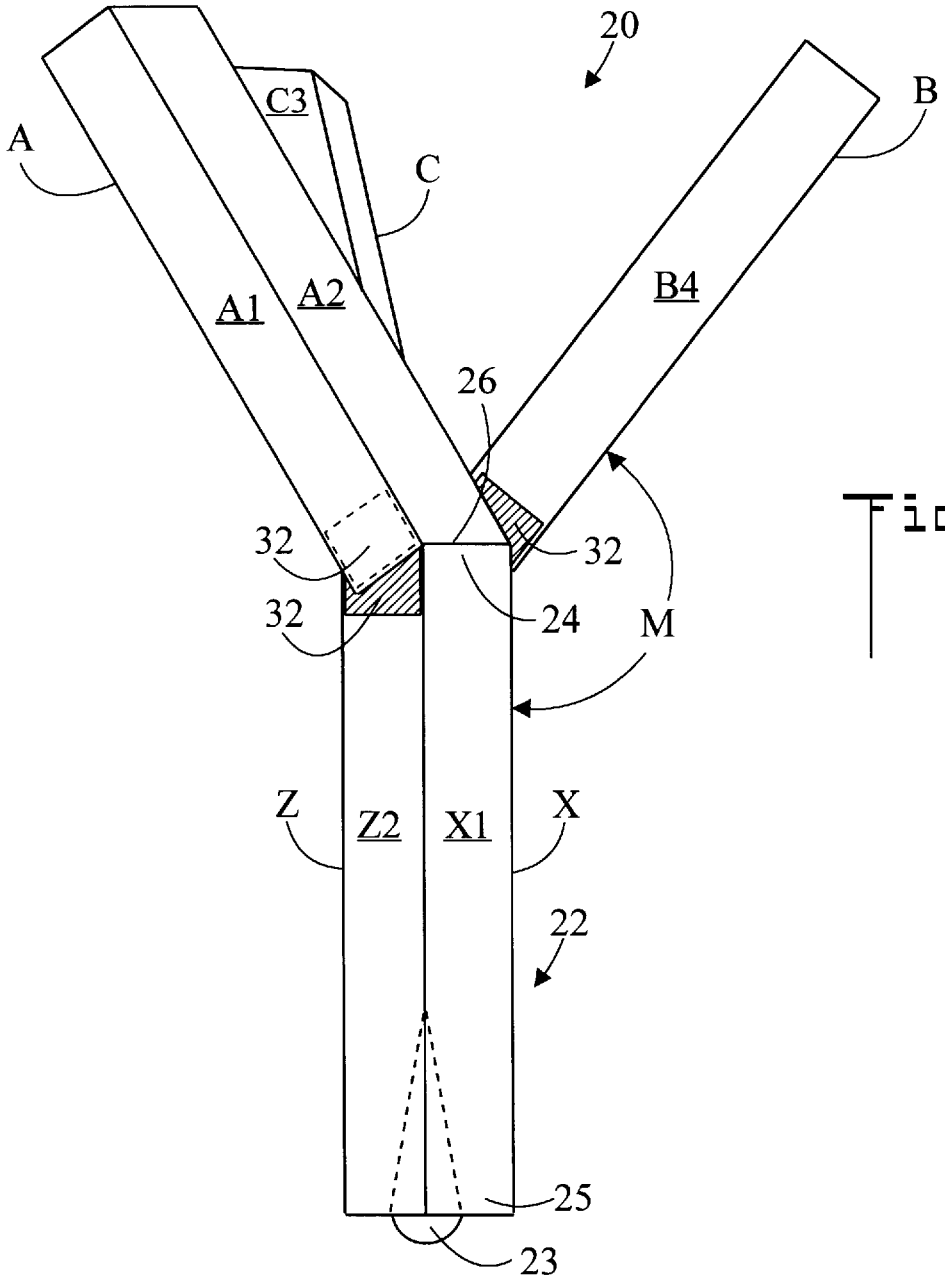
FIG. 3 is a side elevation view along the line 3 of FIG. 1.
Figure 4:
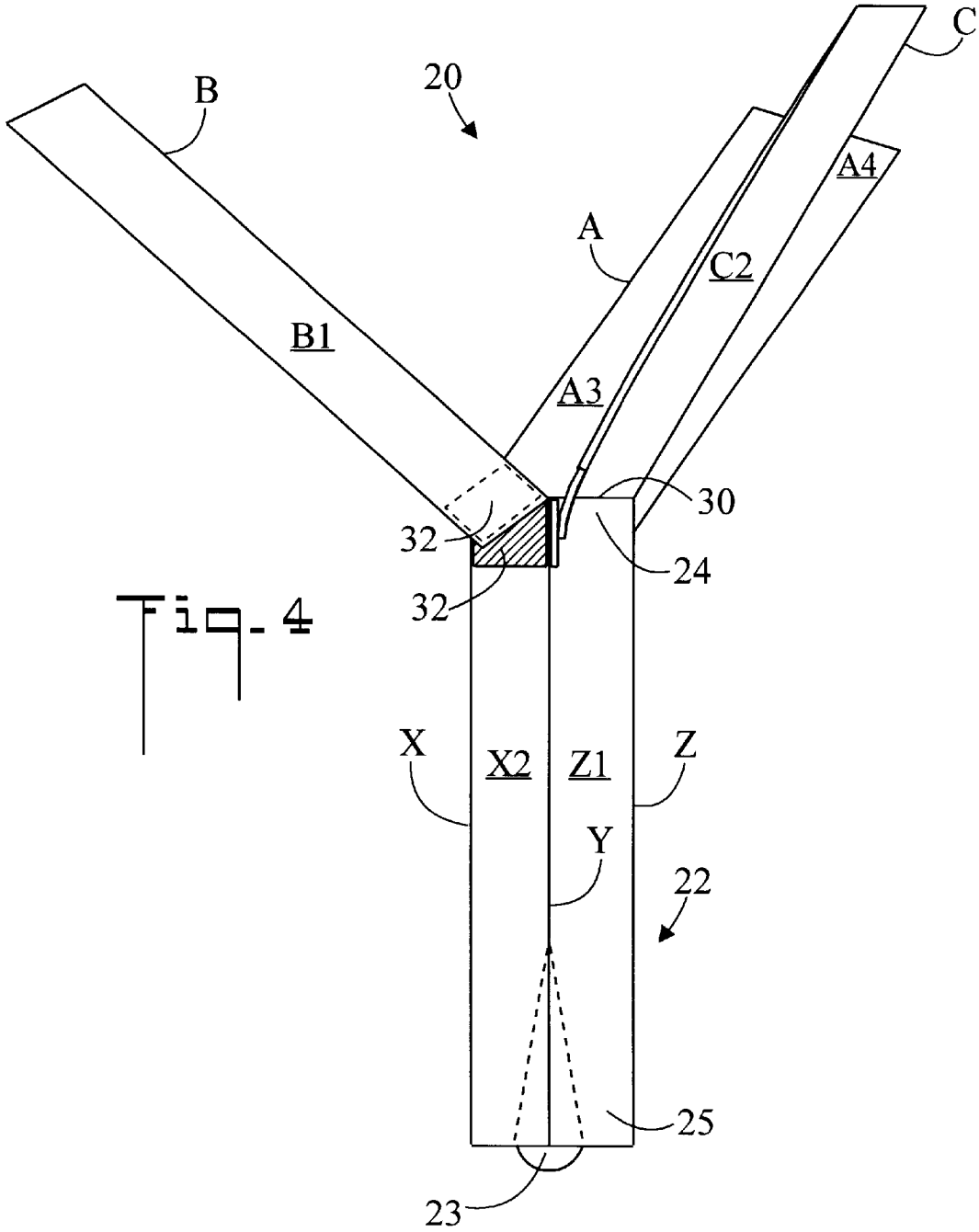
FIG. 4 is a reverse side elevation view along the line 4 of FIG. 1.
Figure 5:
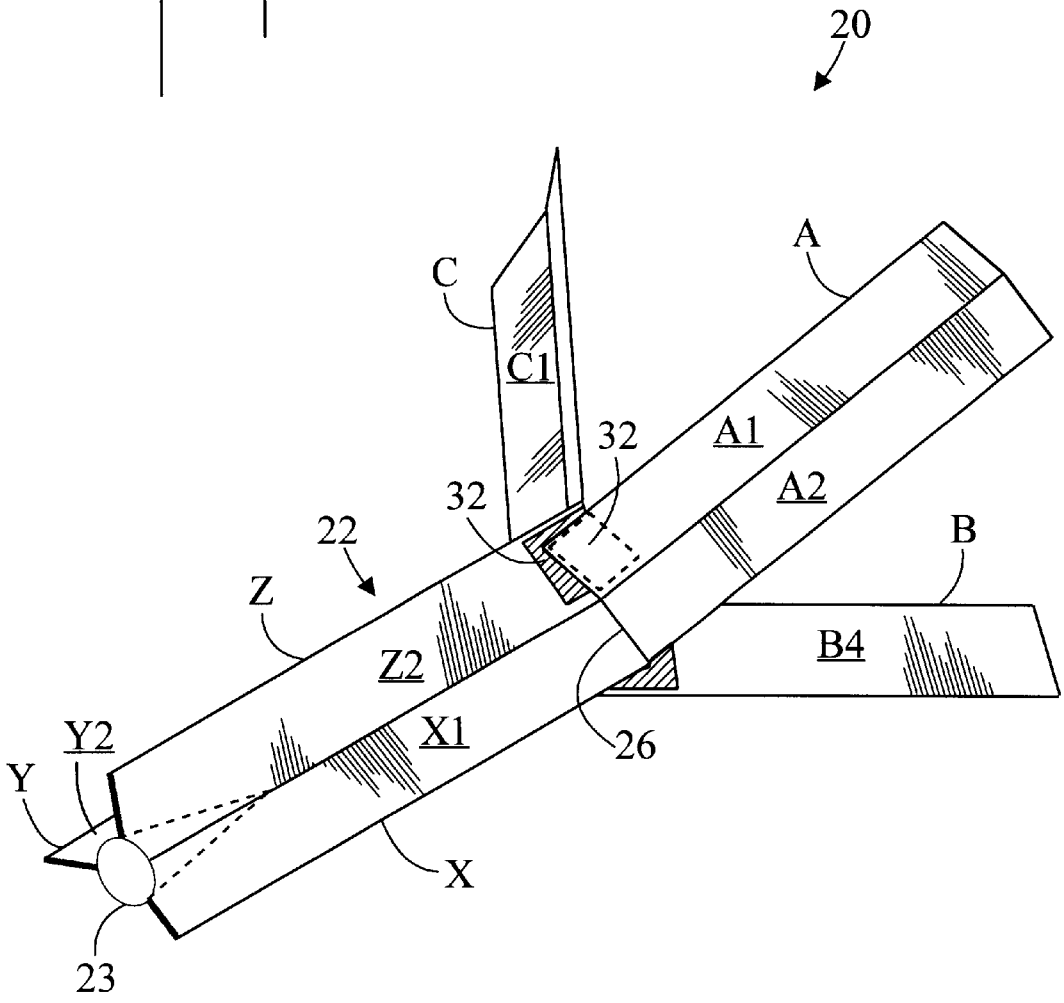
FIG. 5 is a perspective view of the device.

Referring initially to FIGS. 1—5, there are illustrated top plan, bottom plan, side elevation, reverse side elevation, and perspective views respectively of an aerial device in accordance with the present invention, generally designated as 20. Aerial device 20 includes a weighted body 22 having a first end 24 and an opposite second end 25. In a preferred embodiment, a weight 23 is attached near second end 25 of body. Body 22 has at least three radially projecting vanes.X, Y, and Z at first end 24. Aerial device 20 also includes at least three corresponding blades A, B, and C, each blade pivotally connected to a vane along an axis, so that the blades may be folded against body 22 (refer also to FIG. 12). In the shown embodiment, blade A is pivotally connected to vane X along axis 26, blade B is pivotally connected to vane Y along axis 28, and blade C is pivotally connected to vane Z along axis 30. In a preferred embodiment, the connection of the blades to the vanes can be made with a plastic hinge oriented along each of axes 26, 28, and 30. Each blade is selectively and releasably connectable to an adjacent vane, so that the blade projects outwardly from body 22 to assume an flying configuration. In FIG. 3 it is seen that the blades form an angle M with body 22. Blade A is selectively connected to vane Z, blade B is selectively connected to vane X, and blade C is connected to vane Y. In a preferred embodiment, hook and loop fasteners 32 are utilized to selectively connect the blades to the adjacent vanes. One of hooks or loops is disposed on the vane at end 24, and the other of hooks and loops is disposed on the back side of the blade.

It is further noted, that when the blades are connected to the adjacent vane or folded against the body, each blade is substantially comprised of two surfaces intersecting at an obtuse angle. For clarity, the surfaces of the blades and vanes have been nomenclatured. When thrown, the forward facing surfaces of blades A, B, and C are designated A1, A2, B1, B2, C1, and C2. The reward facing surfaces are designated A3, A4, B3, B4, C3, and C4. The surfaces of the vanes are similarly nomenclaured as X1, X2, Y1, Y2, Z1, and Z2. Using this nomenclature, it may be readily appreciated that surfaces A2 and A3 are pivotally connected to vane X, surfaces B2 and B3 are pivotally connected to vane Y, and surfaces C2 and C3 are pivotally connected to vane Z. And that for flight, surface A4 selectively connects to surface Z2, surface B4 selectively connects to surface X2, and surface C4 selectively connects to surface Y2.

In the shown preferred embodiment, aerial device 20 includes three blades and body 22 has three vanes spaced 120° apart. The three blades are connected to the three vanes as is described above. It may be appreciated however that more blade/vane pairs could be included. For example, four blades could be connected to four vanes wherein the vanes are spaced 90° apart.

Figure 6:
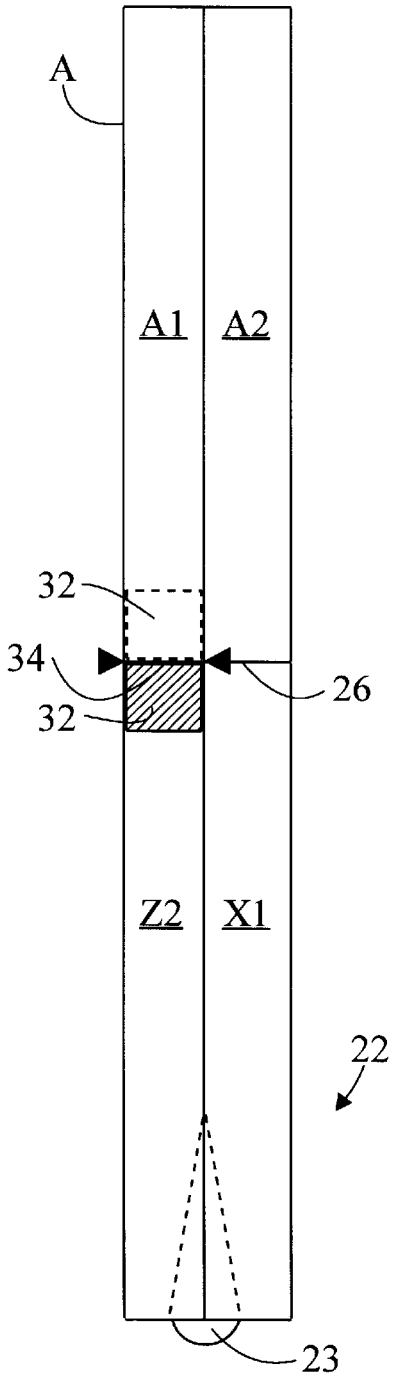
FIG. 6 is a side elevation view of blade A in a upright position.

FIG. 6 is a side elevation view (along the line 3 of FIG. 1) of blade A in an upright position. Blades B and C have been omitted for clarity. Blade A has a lower unconnected edge 34 which extends along the bottom of surfaces A1 and opposite surface A4. One of hook and loop fasteners 32 is disposed on surface A4, and the other of hook and loop fasteners 32 is disposed on surface Z2.

Figure 7:
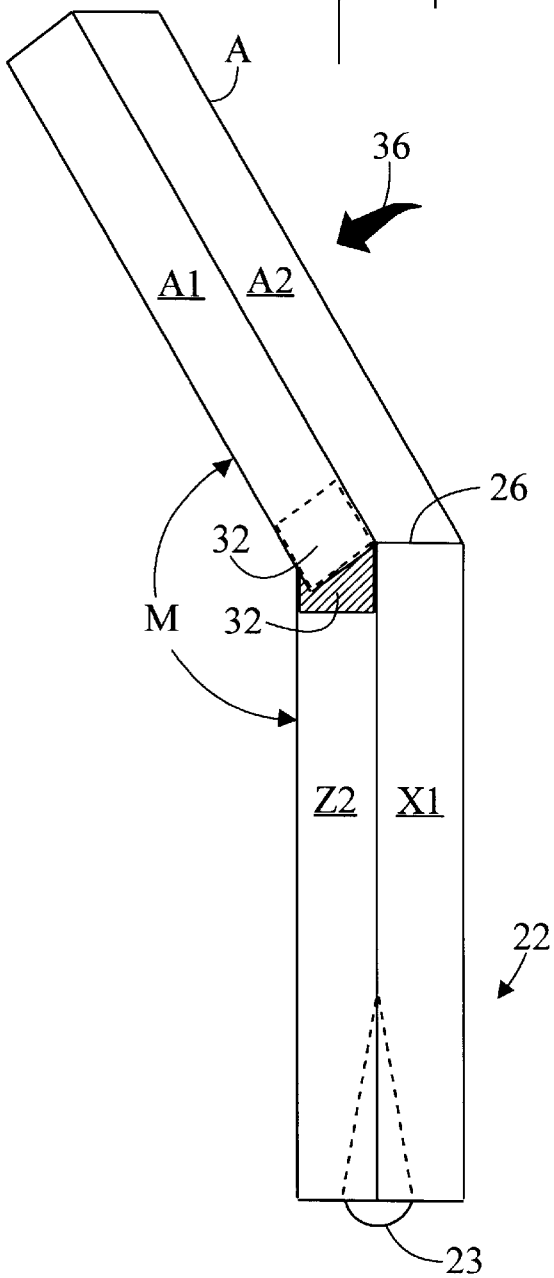
FIG. 7 is a side elevation view of blade A folded into a flying position.

FIG. 7 is a side elevation view of blade A folded into a flying position. Blade A has been rotated in direction 36, and the hook and loop fasteners on surfaces A4 and Z2 so that blade A forms an angle M with body 22. It may be appreciated that blade A could have been folded so that angle M is greater or lesser.

Figures 8, 9:
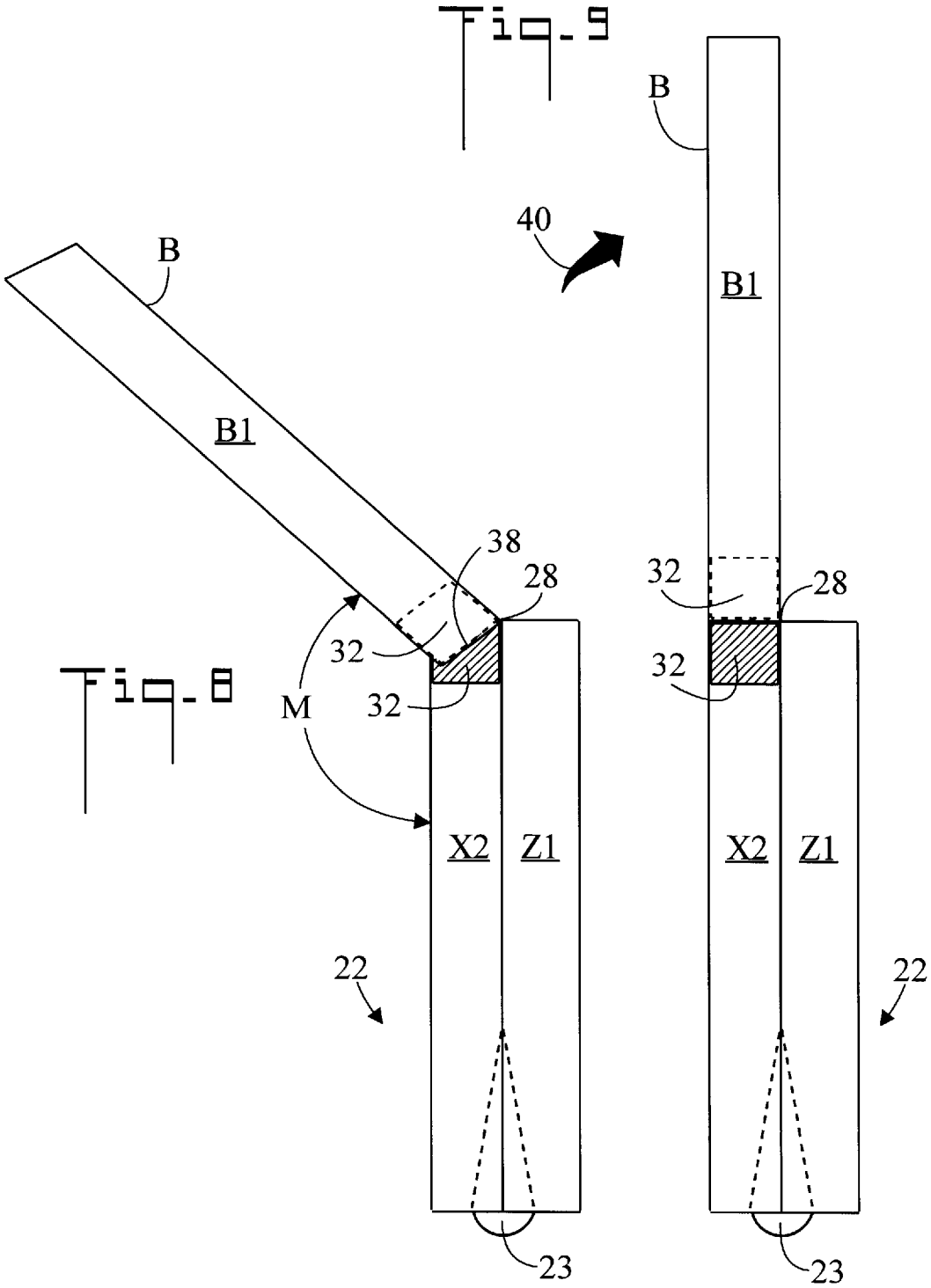
FIG. 8 is a side elevation view of blade B folded into a flying position.
FIG. 9 is a side elevation view of blade B folded to an upright position.

FIG. 8 is a side elevation view (along the line 4 of FIG. 1) of blade B folded into a flying position. Blades A and C have been omitted for clarity. Blade B has a lower unconnected edge 38 which extends along the bottom of surfaces B1 and opposite surface B4. One of hook and loop fasteners 32 is disposed on surface B4, and the other of hook and loop fasteners 32 is disposed on surface X2. Blade B forms an angle M with body 22.

FIG. 9 is a side elevation view of blade B folded in direction 40 along axis 28 to an upright position.

Figures 10, 11, 12:
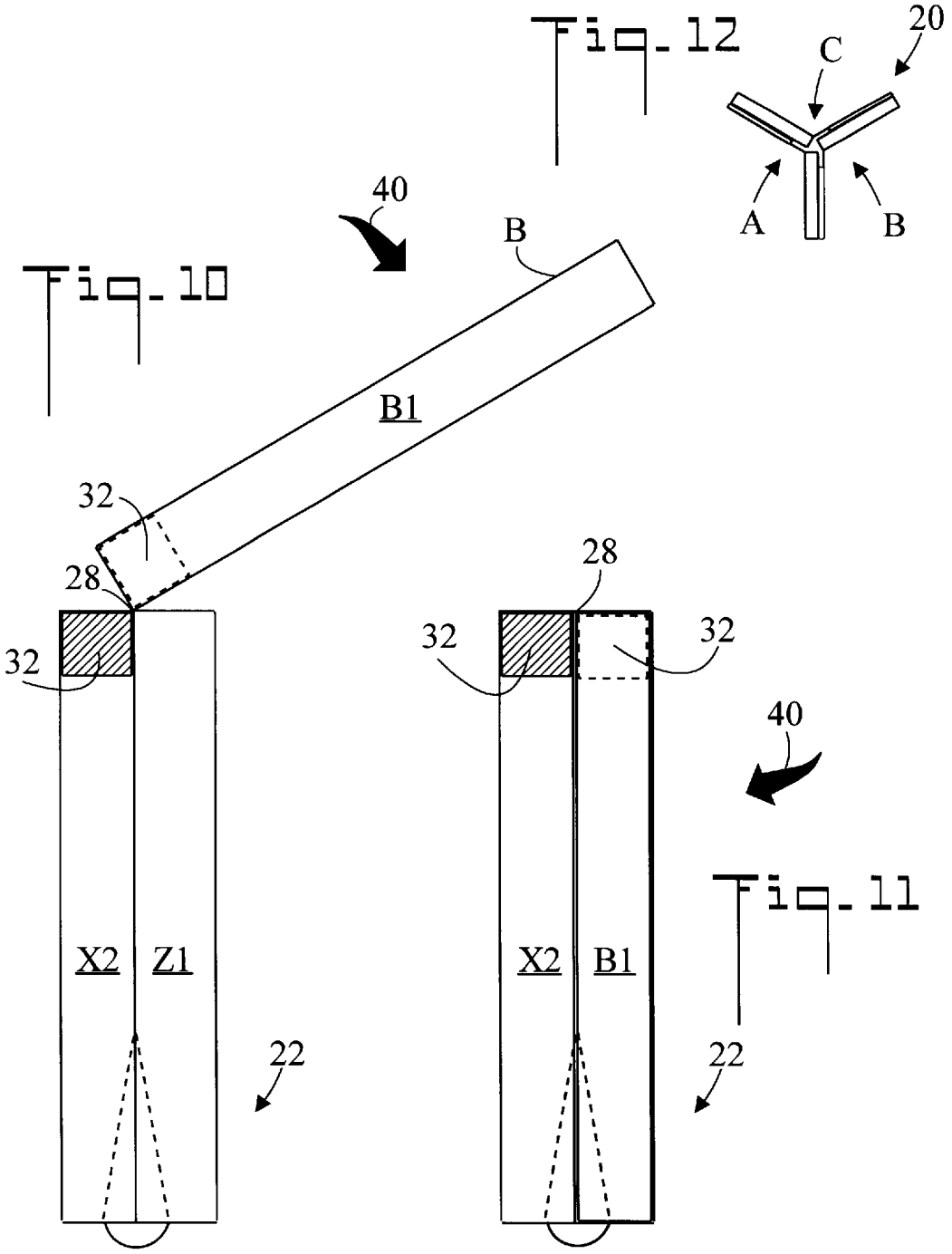
FIG. 10 is a side elevation view of blade B being folded to a stored position.
FIG. 11 is a side elevation view of blade B completely folded to a stored position.
FIG. 12 is a top plan view of the device with all blades folded to a stored position.

FIG. 10 is a side elevation view of blade B continuing to be folded in direction 40 along axis 28 to a stored position.

FIG. 11 is a side elevation view of blade B completely folded in direction 40 along axis 28 to a stored position wherein surface B3 abuts surface Y2 of vane Y, and surface B4 abuts surface Z1 of vane Z.

FIG. 12 is a top plan view (in direction 4 of FIG. 1) of the aerial device 20 with all blades folded to a stored position. The three blades abut the surfaces of the three vanes. That is, surface A3 abuts surface X2, surface A4 abuts surface Y1, surface B3 abuts surface Y2, surface B4 abuts surface Z1, surface C3 abuts surface Z2, and surface C4 abuts surface Z1.

Figure 13:
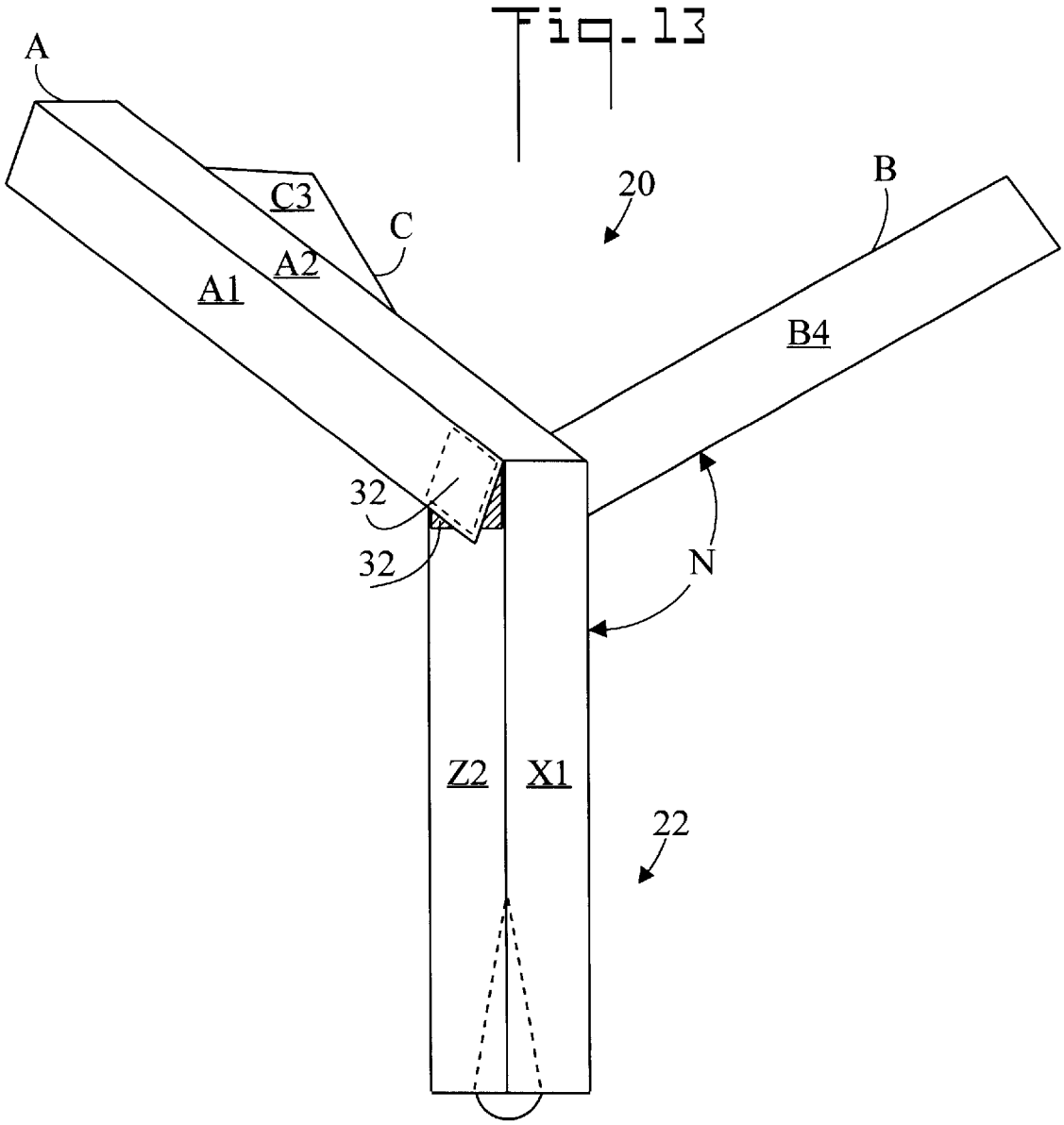
FIG. 13 is a side elevation view of the blades folded to a different flying position.

FIG. 13 is a side elevation view of the blades folded to a different flying position. The blades have been folded and connected to form an angle N with body 22 which is smaller than angle M shown in FIG. 3. A larger angle, such as angle M, results in a more streamlined aerial device that offers less air resistance, and thereby will generally go faster and travel further. Conversely, a smaller angle, such as N, results in a less streamlined aerial device that offer more air resistance, and thereby will generally go slower and travel a shorter distance. The angle which the blades form with the body can also affect the speed of rotation of the aerial device 20.

Figure 14:
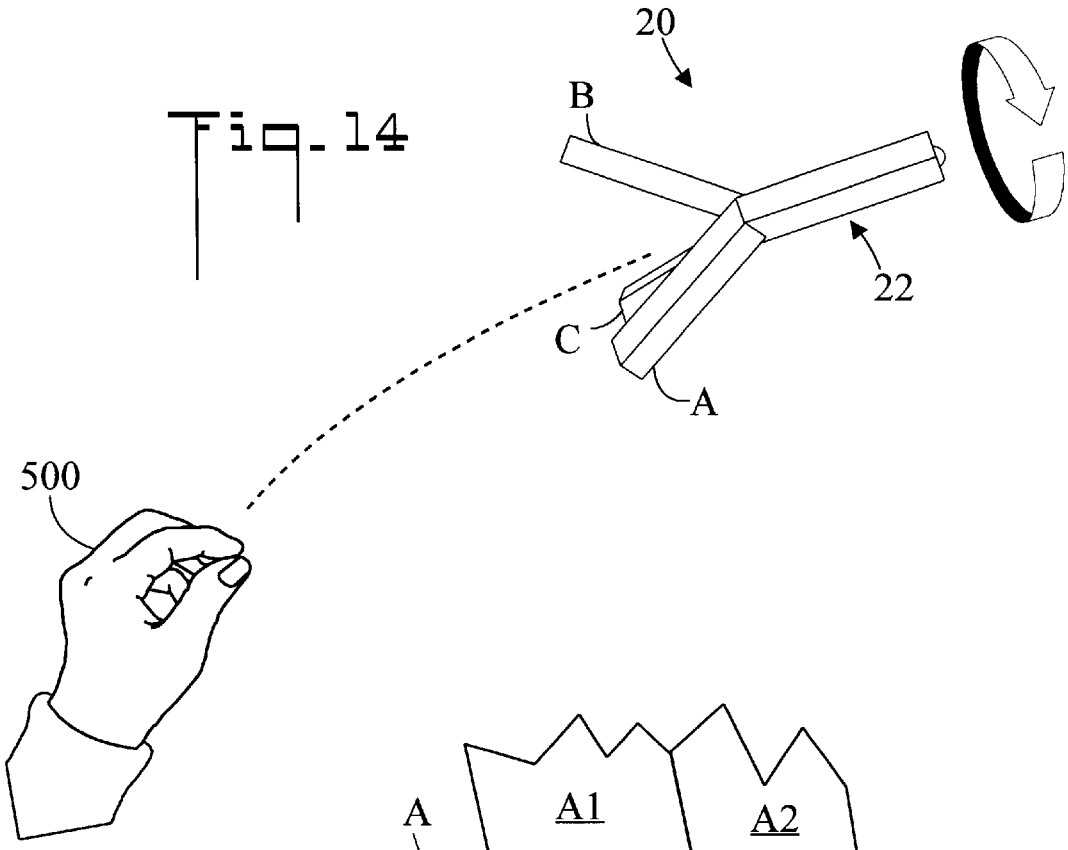
FIG. 14 is a reduced side elevation view of the device being thrown by a user; and, FIG. 15 is an enlarged perspective view of a hinge connecting blade A to vane X.

FIG. 14 is a reduced side elevation view of aerial device 20 being thrown by a user 500. The force of the air upon the blades cause aerial device 20 to rotate as it travels through the air. Referring again to FIG. 2, the direction of rotation will be counterclockwise when viewed from the front of aerial device 20.

Figure 15:
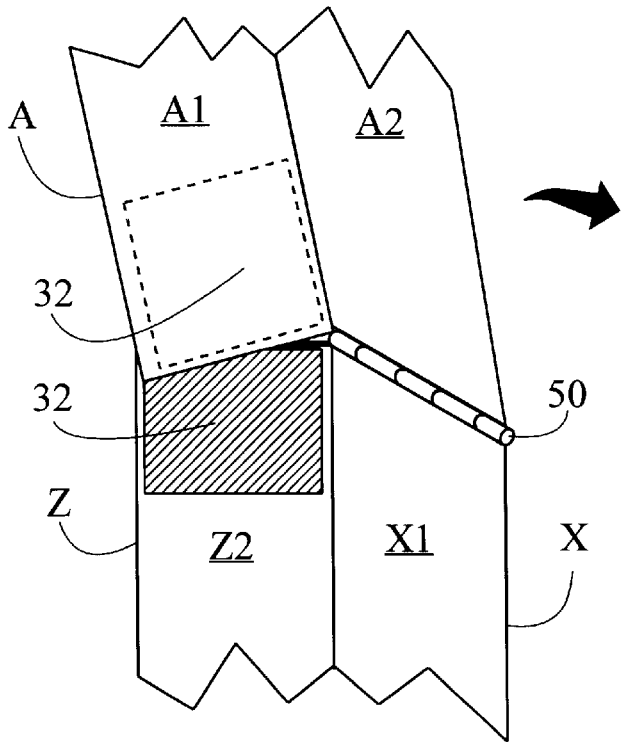

FIG. 15 is an enlarged perspective view of a hinge 50 pivotally connecting blade A to vane X. Similar hinges would connect blade B to vane Y, and blade C to vane Z.

The blades of aerial device 20 may be fabricated from any flexible sheet material. In a preferred embodiment, the blades are made from heavy duty paper of the "manila folder" type. The blades could also be fabricated from a sheet polymer. A hinge can also be utilized to connect the blades to the vanes. The body 22 of aerial device 20 can be fabricated from heavy duty paper, plastic, or wood, and should be more rigid than the blades. A piece of metal can be used as weight 23 to body 22.

Aerial device 20 is used by connecting the three blades to the three adjacent vanes so that the three blades project outwardly forming an angle M with the body 22. A user 500 grasps the body 22 and throws the aerial device 20 into the air second end 25 first.

To achieve a different flight profile, the user 500 adjusts the connection of the three blades with the three vanes so that the blades form a different angle N with the body 22.

To store or ship aerial device 20, the user 500 disconnects the three blades from the three adjacent vanes, and folds the three blades against the body 22.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. A flying device which rotates as it travels through the air, comprising:

a weighted body having a first end and an opposite second end, said body having at least three radially projecting vanes at said first end;

at least three corresponding blades, each blade pivotally connected to a said vane along an axis, so that said blades may be folded against said body;

each said blade selectively connectable to an adjacent said vane, so that said blade projects outwardly from said body; and, when said blades are connected to said adjacent vane or folded against said body, each said blade including two surfaces intersecting at an obtuse angle.

2. A flying device which rotates as it travels through the air, comprising:

a weighted body having a first end and an opposite second end, said body having at least three radially projecting vanes at said first end;

at least three corresponding blades, each blade pivotally connected to a said vane along an axis, so that said blades may be folded against said body;

each said blade selectively connectable to an adjacent said vane, so that said blade projects outwardly from said body;

hook and loop fasteners selectively connecting said blade to said adjacent vane;

said vanes spaced 120° apart; and, when said blades are connected to said adjacent vane or folded against said body, each said blade including two surfaces intersecting at an obtuse angle.

* * * * *